US005305889A

United States Patent [19]

Ganz

[11] Patent Number: 5,305,889

[45] Date of Patent: Apr. 26, 1994

[54] CENTER FEED CYCLONE

[76] Inventor: John M. Ganz, 346 S. Pennsylvania, Wellston, Ohio 45692

[21] Appl. No.: 779,062

[22] Filed: Oct. 18, 1991

[51] Int. Cl.[5] ..... B04C 5/02; B04C 5/06

[52] U.S. Cl. ..... 209/734; 209/148; 209/718; 209/725

[58] Field of Search ..... 209/208, 210, 211, 144, 209/148, 149, 143; 210/512.3

[56] References Cited

U.S. PATENT DOCUMENTS

| | | | |
|---|---|---|---|
| 2,645,347 | 7/1953 | Baxter, Jr. | 209/211 |
| 2,965,232 | 12/1960 | Vane | 209/211 |
| 3,024,908 | 3/1962 | Ibing et al. | 209/144 |
| 3,642,129 | 2/1972 | McDaniel et al. | 209/211 X |
| 3,887,456 | 6/1975 | Loughner | 209/211 |
| 4,038,178 | 7/1977 | Hukki | 209/208 X |
| 4,301,000 | 11/1981 | Rankin | 209/211 X |
| 4,629,564 | 12/1986 | Pinato | 210/512.3 |
| 4,981,219 | 1/1991 | Burnell et al. | 209/211 X |

FOREIGN PATENT DOCUMENTS

| | | | |
|---|---|---|---|
| 0714364 | 7/1965 | Canada | 209/211 |
| 1186313 | 1/1965 | Fed. Rep. of Germany | 209/144 |
| 0131113 | 8/1983 | Japan | 210/512.3 |
| 0376119 | 6/1973 | U.S.S.R. | 209/211 |
| 0978925 | 12/1982 | U.S.S.R. | 209/144 |
| 0371909 | 5/1932 | United Kingdom | 209/144 |

*Primary Examiner*—James R. Bidwell

*Attorney, Agent, or Firm*—Richard M. Klein; Paula E. Ganz

[57] ABSTRACT

The present invention is directed to an improved method and apparatus to separate solids particles from a liquid medium and/or classify suspensions of particles according to particle characteristics by centrifugal force, wherein the feed stream is introduced to the cyclone apparatus at a location along the central internal axis of the cyclone.

72 Claims, 6 Drawing Sheets

CENTER FEED CYCLONE

BACKGROUND OF THE INVENTION

The present invention is directed to an improved method and apparatus to separate solids particles from a liquid medium and/or classify suspensions of particles according to particle characteristics by centrifugal force, wherein the feed stream is introduced to the cyclone apparatus at a location along the central internal axis of the cyclone.

Cyclones are in wide use throughout the solids processing industries. Cyclones are commonly used to separate solids from a liquid medium and/or to classify suspensions of particles according to particle characteristics. A typical cyclone will be described for purposes of generally describing the prior art with reference to FIG. 1.

A typical prior art cyclone consists of a cylindrical shell 1 to which is joined at the bottom orifice an inverted conical shell 2. The cone angle of the inverted conical shell 2 may be constant or variable, and the cone may be curved rather than linear. One widely used cyclone, patented by Visman (U.S. Pat. No. 3,353,673), has an inverted conical shell consisting of three conical segments, each with a different slope. The cylindrical shell 1 is closed at the top. The inverted conical shell 2 is truncated and open at the bottom. The bottom opening is commonly known as the underflow nozzle or apex orifice 3. It will be understood by those skilled in the art that the designations "top" and "bottom" do not necessarily designate or restrict the cyclone's spatial orientation, as the cyclone may be operated with its central axis oriented vertically, horizontally, or on an inclined angle.

Cyclones with elongated conical shells (i.e., a shallow conical angle) are often referred to as "thickening" cyclones, and are more useful in the concentration of very fine particles. Cyclones that have a relatively moderate cone angle and thus an inverted conical shell of medium length are known as "heavy media" cyclones and are most useful in separating particles according to particulate characteristics. Cyclones with an extremely sharp cone angle and therefore a particularly short inverted conical shell are known as "hydrocyclones" and are typically used to remove heavy solids particles from the feed mixture. The Visman tricone described above is a type of hydrocyclone.

A vortex finder 4, also known as an overflow nozzle, is centrally mounted along the internal axis of the cyclone. The vortex finder 4 extends through the top of the cylindrical shell 1 into the interior of the cyclone, terminating near the juncture of the cylindrical shell 1 and the inverted conical shell 2.

The feed stream, consisting of the particulate material and its entraining liquid, is delivered to the cyclone under pressure, and is introduced to the cyclone through a feed nozzle 5 at the wall of the cylindrical shell 1.

The entering material forms characteristic whirling movement patterns whereby it separates into two rotating streams. The movement patterns have been described elsewhere, for example by Tomlinson (U.S. Pat. No. 3,096,075). An air core forms along the central internal axis from the apex orifice 3 upward into the vortex finder 4. Heavy particles, and/or smaller particles of relatively higher specific gravity, tend to spiral downward along the inner wall of the inverted cylindrical shell 1 toward, and ultimately exiting through, the apex orifice 3. The liquid, containing smaller lighter solids particles, forms a vortex pattern swirling and spiraling upward around the air core and into the bottom of the vortex finder 4.

Inside a cyclone in which the pattern of material separation has been formed and defined, the incoming pressurized feed stream merges with the mass of material that is spiralling downward toward the apex nozzle. The feed stream is introduced near the outermost edge of the downwardly rotating mass, where the centrifugal force of the rotating mass is lowest. Prior art cyclones typically exhibit severe wear of the interior wall of the cyclone near the feed nozzle.

OBJECTS OF THE INVENTION

A primary object of the present invention is to provide a novel method and apparatus to separate solids particles from a liquid medium and/or to classify suspensions or particles according to particle characteristics by centrifugal force.

Another object of the present invention is to provide a novel method and apparatus to introduce the solids/liquids feed stream to the cyclone apparatus.

Another object of the present invention is to provide a novel method and apparatus to introduce the solids/liquids feed stream to the cyclone apparatus in a manner that conserves more of the momentum of the incoming solids/liquids feed stream.

Another object of the present invention is to provide a novel method and apparatus to introduce a solids/liquids feed stream to the cyclone apparatus in a manner that reduces the energy required to operate the cyclone.

Another object of the present invention is to provide a novel method and apparatus to introduce a solids/liquids feed stream to the cyclone apparatus in a manner that reduces and minimizes wear on the interior wall of the cyclone.

Other objects of the invention will be appreciated by a study of the following specification taken in conjunction with the accompanying drawings.

SUMMARY OF THE INVENTION

More specifically, the present invention provides a cyclone apparatus consisting of a cylindrical shell to which is joined at the bottom orifice an inverted conical shell, and to which is joined at the top orifice an upright conical shell.

This invention encompasses all configurations of the inverted conical shell found in the prior art, including thickening cyclones, heavy media cyclones, and hydrocyclones. According to this invention, the cone angles of the inverted and upright conical shells may be constant or variable. The cones may be curved or in part curved rather than linear, and may be in part convex rather than concave. There may be, but need not be, symmetry as to the shapes of the inverted and upright conical shells.

As in prior art cyclones, the inverted conical shell is truncated and open at the bottom. The upright conical shell is similarly truncated and open at the top. The opening at the top of the upright conical shell need not be the same diameter as the opening at the bottom of the inverted conical shell; it may be desirable to have a larger opening at the top of the upright conical shell than the opening at the bottom of the inverted conical shell. As in the prior art, it must be understood that descriptive spatial designations such as "top" and "bottom" do not designate or restrict the cyclone's spatial orientation, as the cyclone may be operated with its central axis oriented vertically, horizontally, or on an inclined angle.

A feed pipe is mounted along the central internal axis of the cyclone, entering the cyclone at the top orifice of the upright conical shell. The feed pipe terminates somewhere in the interior of the cyclone, as appropriate to the conditions of the feed and objectives of the separation or classification process. The feed pipe terminates in one or more feed ports that discharge the solids/liquid feed mixture in the direction of the rotating mass inside the cyclone. The feed pipe may be fastened to an adjustable support outside of the cyclone so that the position of the feed ports may be adjusted up or down along the central internal axis of the enclosure as appropriate for the conditions of the feed and the objectives of the separation or classification process. The position of the feed ports may be adjusted even while the cyclone is in operation if the feed supply line connecting to the feed pipe is sufficiently flexible.

The feed stream moves under pressure through the feed pipe, then exits the feed ports and enters the interior of the cyclone. The entering feed stream forms a movement pattern whereby the incoming feed, upon merging into the whirling mass inside the cyclone, separates into two streams. The heavier solids travel farther toward the outer circumference of the enclosure and, under pressure from the incoming feed stream, rotate downward along the interior wall of the cylinder and the inverted conical shell, ultimately exiting the cyclone with a small fraction of the feed water through the apex orifice at the bottom of the inverted conical shell. The lighter solids, suspended in the remaining feed water, rotate upward and ultimately exit the cyclone through the annular opening around the feed pipe at the top of the upright conical shell.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figure 1:
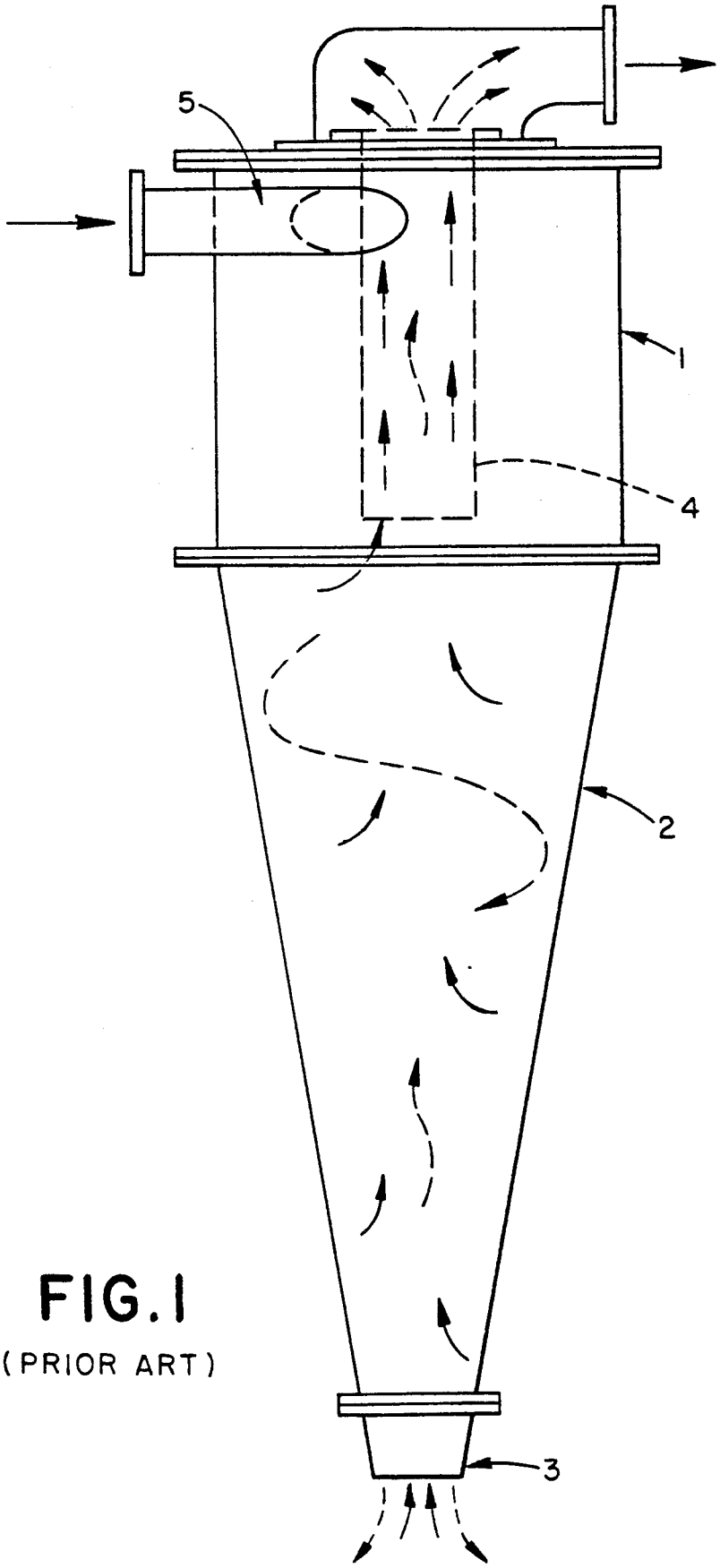
FIG. 1 (PRIOR ART)
FIG. 1 is a side elevational view of a prior art cyclone.
Figure 2A:
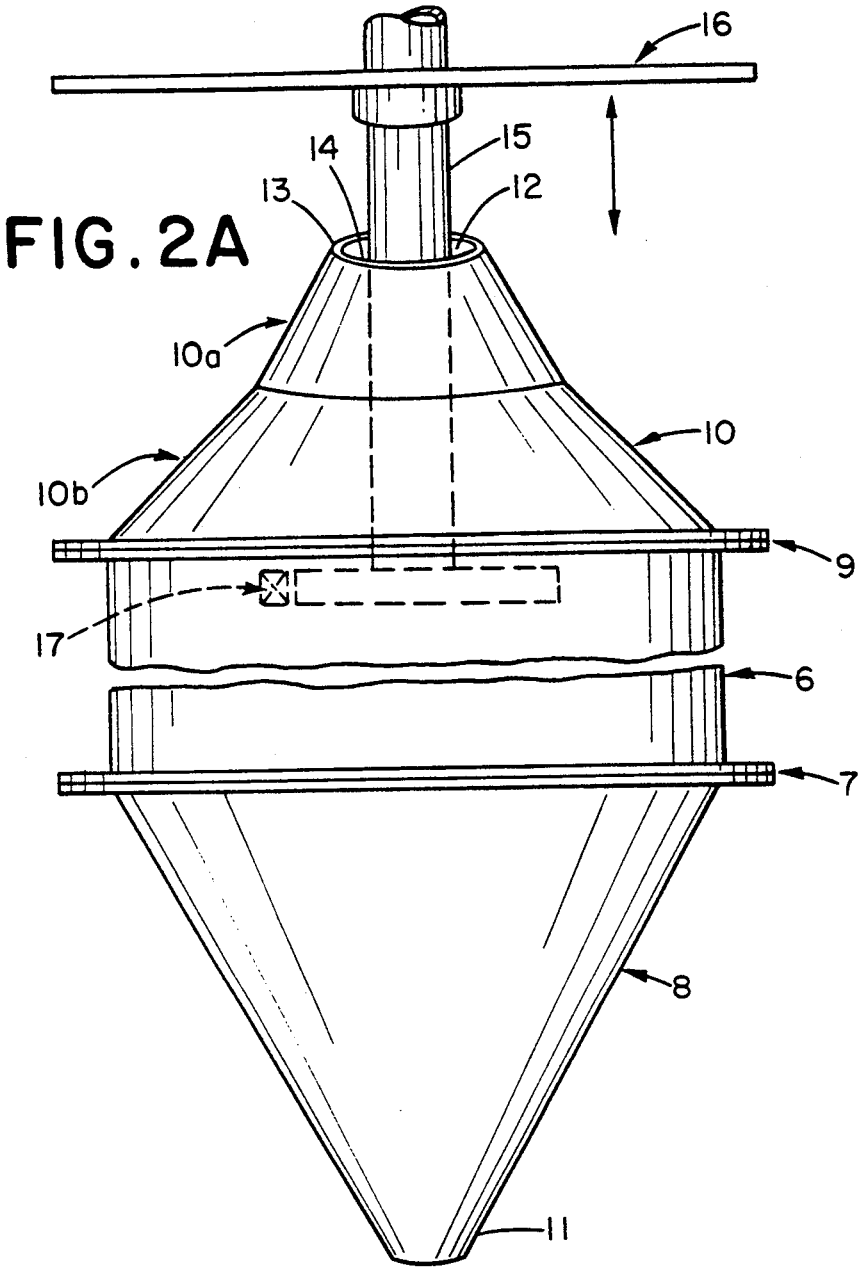
FIGS. 2A through 2D are drawings of cyclone apparatuses embodying the present invention with FIG. 2A representing a side elevational view of the cyclone having that portion of the feed pipe which descends into the cyclone illustrated in phantom and FIG. 2B representing a side elevational view of the cyclone of FIG. 2A containing a splash guard and collection troughs and with FIG. 2C representing in more detail an external adjustable support and a flexible feed supply line which permits vertical movement of the feed line, and adjustment of the position of the feed header, even during operation and with FIG. 2D representing a cyclone with a partially curved conical segment; and, FIGS. 3A, 3B and 3C are drawings of a feed header with multiple feed ports that embodies a method and apparatus for introducing feed to the cyclone contemplated by the present invention with FIG. 3A representing a side elevational view of the feed header, FIG. 3B representing a top view of the feed header, and FIG. 3C representing a side elevational view of the feed header having outlets configured on staggered spatial planes.
Figure 2B:
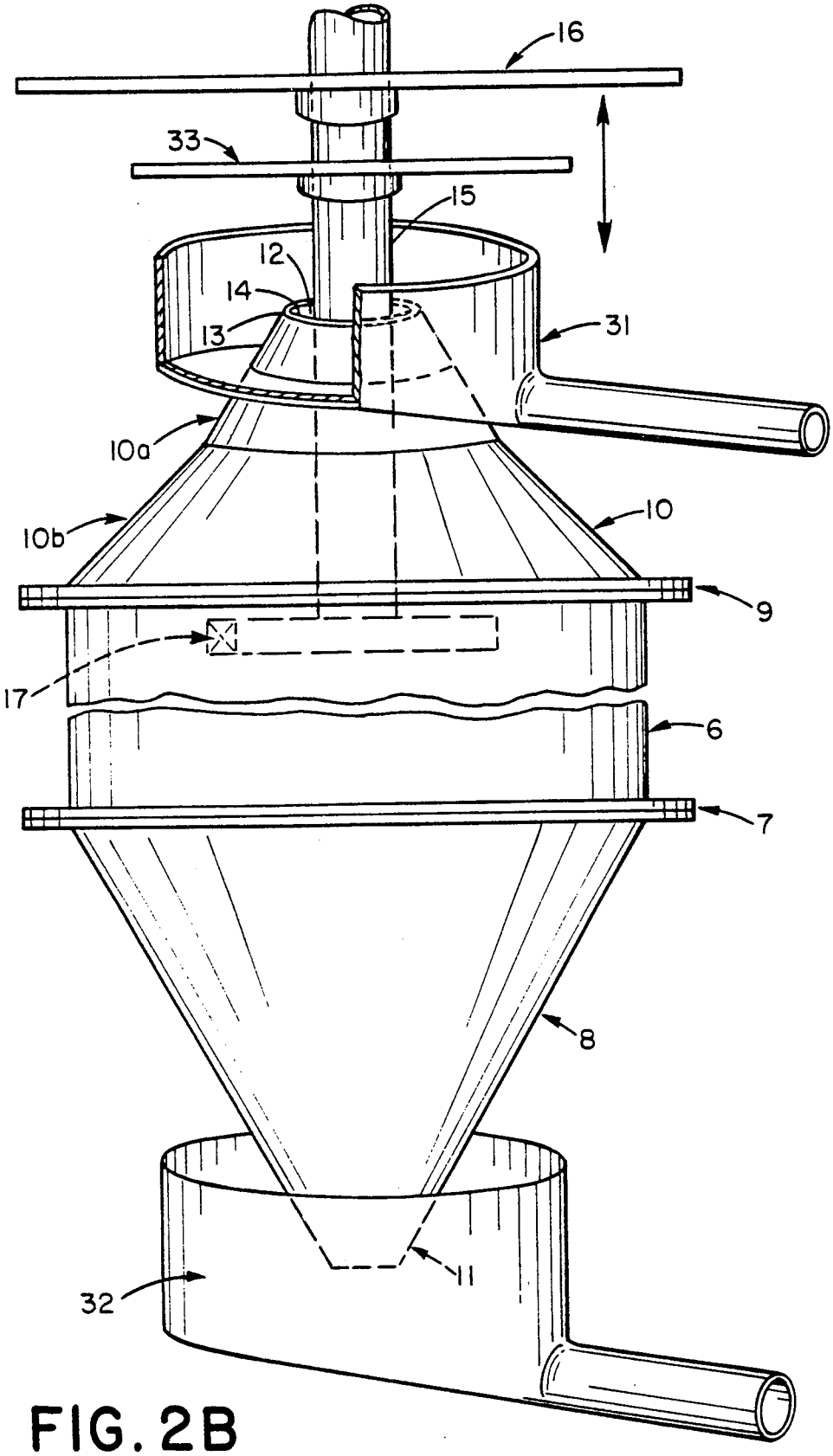
Figure 2C:
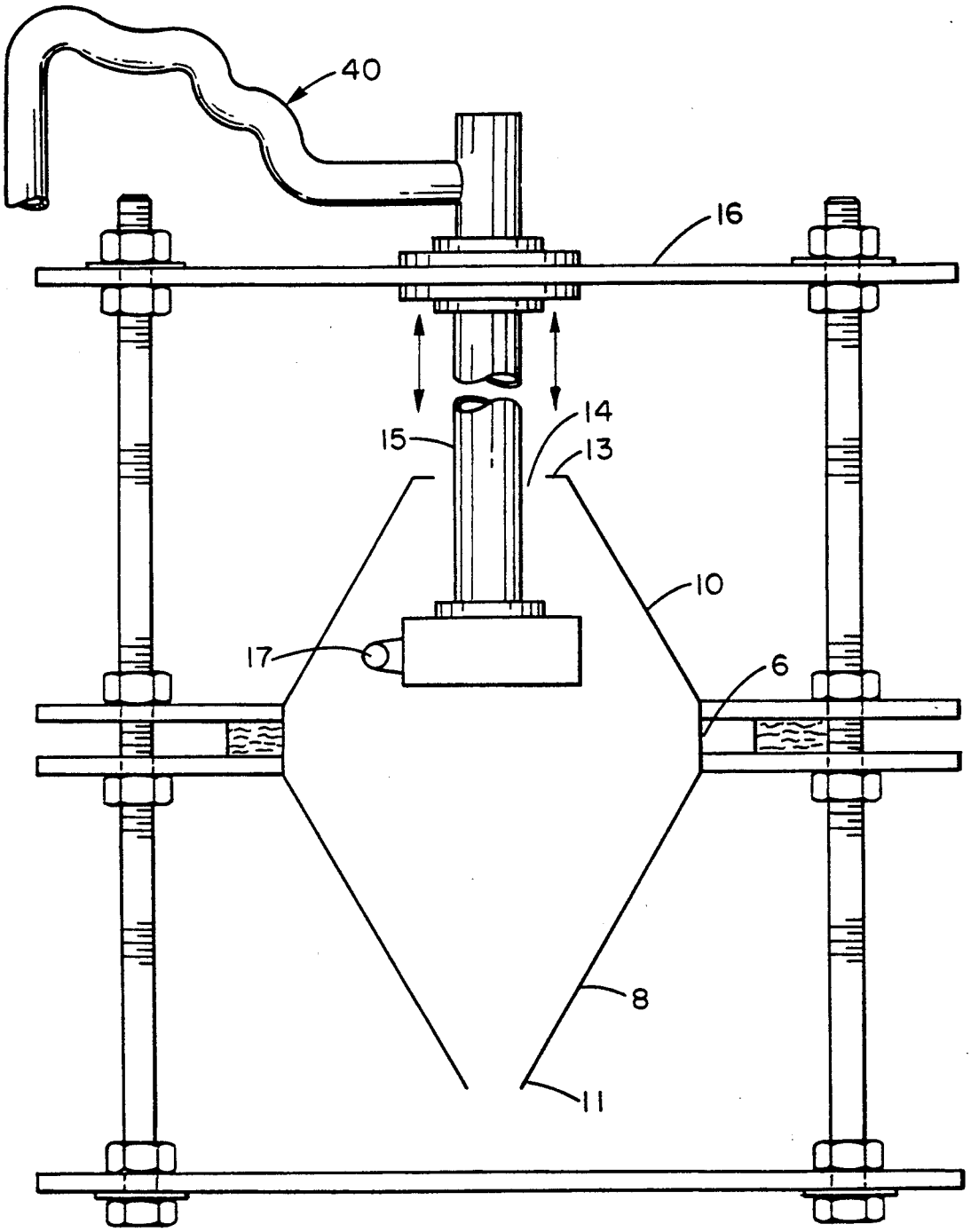
Figure 2D:
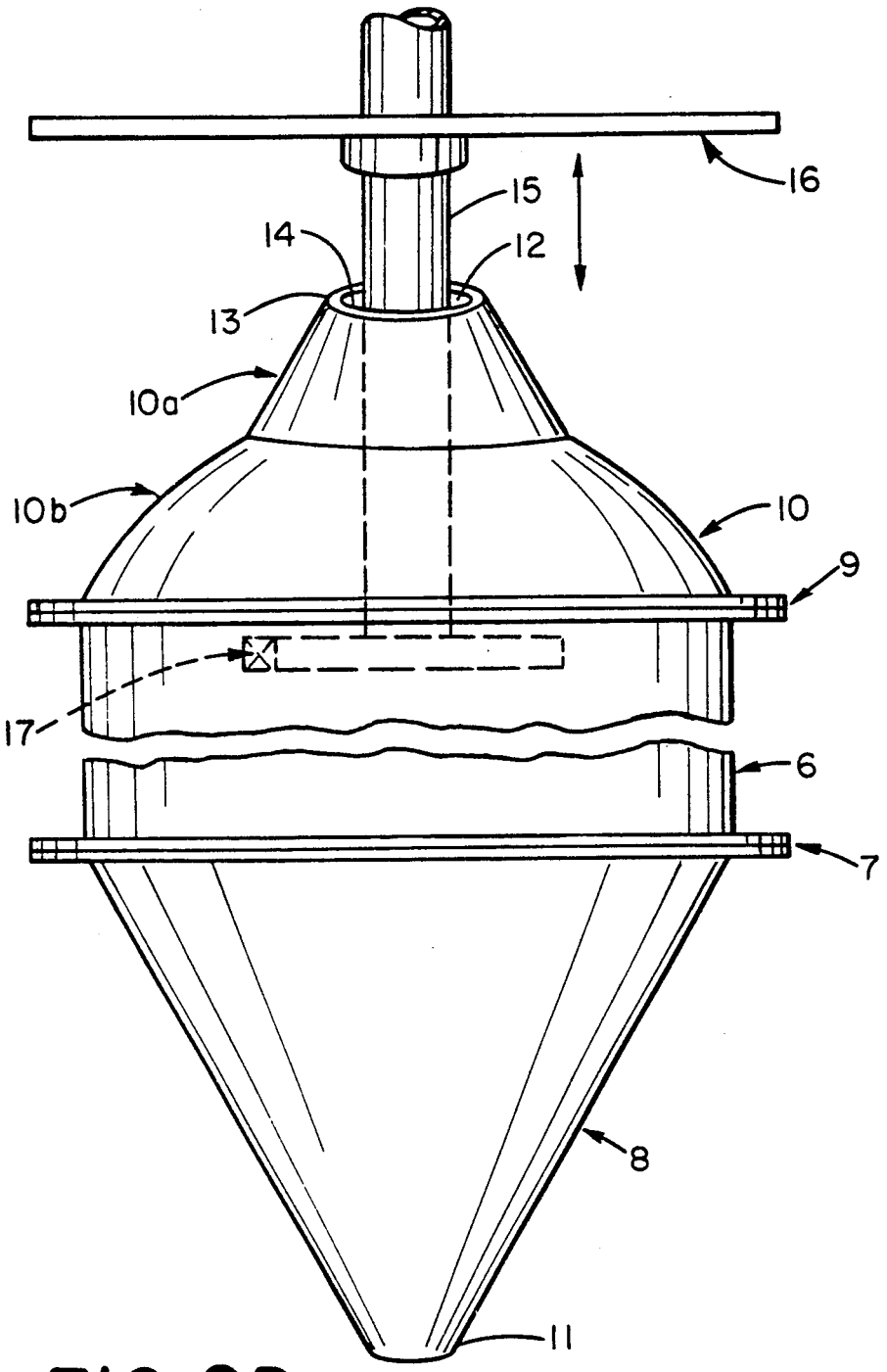

Referring now more specifically to the drawings, wherein the showings are for the purpose of illustrating the preferred embodiment of the invention only and not for purposes of limiting the same, the cyclone apparatus is formed by a cylindrical shell 6 to which is joined at the bottom orifice 7 an inverted conical shell 8, and to which is joined at the top orifice 9 an upright conical shell 10. See FIG. 2A and 2B. The inverted conical shell 8 is truncated and open. The opening at the bottom of the inverted conical shell 8 is known as the apex orifice 11. The upright conical shell 10 is similarly truncated and open. The annular orifice 12 at the top of the upright conical shell 10 has an outside diameter 13 defined by the upright conical shell 10, and an inside diameter 14 defined by a feed pipe 15 which descends into the cyclone apparatus through the opening at the top of the upright conical shell 10. The outside diameter 13 of the annular orifice 12 may be larger than the diameter of the apex orifice 11. The inverted conical shell 8 and the upright conical shell 10 may each have one or more segmented parts 10*a*, 10*b*. The inverted conical shell 8 and the upright conical shell 10, or the segmented parts 10*a*, 10*b*, may be of curved shape or of linear shape.

The feed pipe 15 is centrally mounted along the central internal axis of the cyclone apparatus, forming the inside diameter 14 of the annular opening 12 at the top of the upright conical shell 10. Although the feed pipe 15 may be permanently mounted to a fixed position, it may be desirable, and this invention encompasses the possibility, that the feed pipe 15 shall be mounted on an adjustable support 16 outside the cyclone apparatus, and that said adjustable support 16 permits movement of the feed pipe 15 along the central internal axis of the cyclone apparatus, even while the cyclone apparatus is operating. A flexible feed supply line 40 facilitates adjustment of the feed line while the cyclone is in operation.

The feed pipe 15 terminates in one or more feed port(s) 17, with multiple feed ports 17 being the preferred embodiment to provide more even distribution of the incoming feed. The feed ports 17 discharge the feed radially to the central internal axis of the cyclone. The external adjustable support 16 described above permits upward and downward adjustment of the position of the feed ports 17 along the central internal axis of the cyclone apparatus, even while the cyclone apparatus is operating, to adjust as appropriate to the conditions of the feed and objectives of the separation or classification process.

The feed stream enters the feed pipe 15 under pressure, moves through the feed pipe 15, and is still under pressure as it exits the feed ports 17 into the interior of the cyclone apparatus. An air core forms along the internal axis of the cyclone apparatus, between the apex orifice 11 and the disc sealing the bottom of the feed pipe 15. After leaving the feed ports 17, the feed stream tends to separate into (1) the heavier solids stream that tends to rotate downward along the interior of the cylinder 6 and the inverted conical shell 8, ultimately exiting the cyclone apparatus through the apex orifice 11; and (2) the liquids/lighter solids stream that tends to rotate upward along the interior of the upright conical shell 10, ultimately exiting the cyclone apparatus through the annular orifice 12. A splash shield ring 33 and/or a collection trough 31 can also be provided in an alternative embodiment for collecting materials exiting the annular orifice 12. See FIG. 2B. Similarly, a collecting means 32 for collecting materials exiting the apex orifice 11 can also be provided.

Figure 3C:
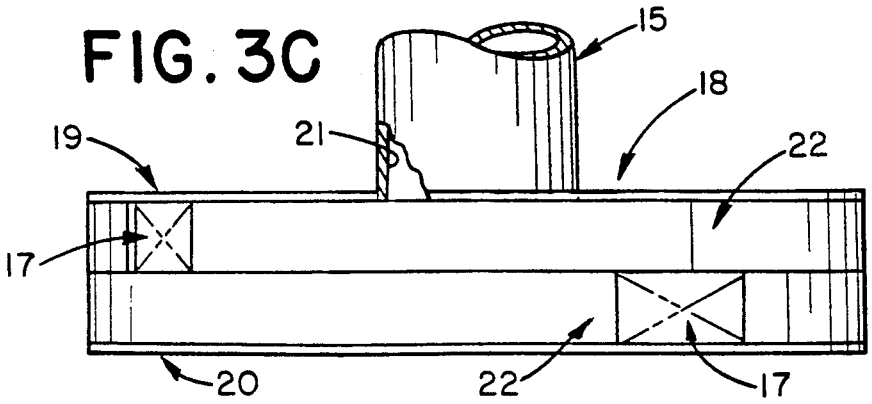
Figure 3A:
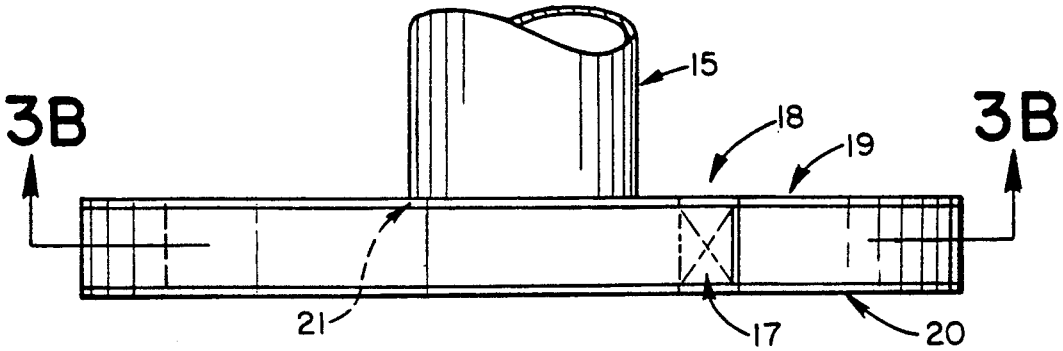
Figure 3B:
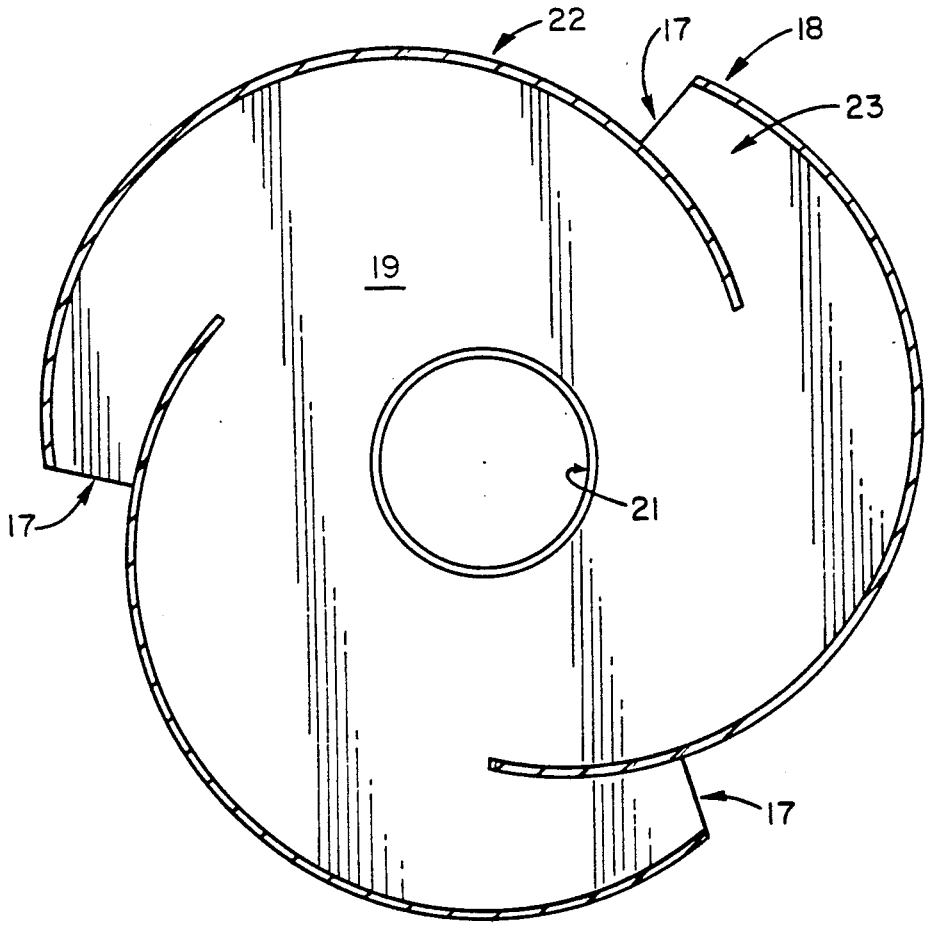

A further alternative embodiment of the present invention is equipped with a feed header 18 for discharging the feed from the feed pipe 15 into the cyclone apparatus. See FIGS. 3A, 3B and 3C. The feed header 18 is mounted to the feed pipe 15 where the feed pipe 15 terminates inside the cyclone apparatus. The feed header 18 consists of two parallel discs 19, 20 which may be of irregular contour and also of unequal diameter. The upper parallel disc 19 is mounted to the feed pipe 15. The upper parallel disc 19 contains a feed opening 21 that permits communication with the feed pipe 15.

Blades 22 are mounted between said parallel discs 19, 20. See FIG. 3B. Said blades 22 form one or more channel(s) 23 between the parallel discs 19, 20, opening at the outer edges of the parallel discs 19, 20. Said channels 23 may be tapered so as to have a relatively larger cross-section at the interior of the parallel discs 19, 20 and a relatively smaller cross-section toward the outside edge of the parallel discs 19, 20; this tapering design enhances the velocity of the feed as it exits the feed header 18. Said channels 23 are in communication with the feed pipe 15 through the feed opening 21 at the center of the upper parallel disc 19.

The feed moves under pressure through the feed pipe 15, then through the feed opening 21 in the upper parallel disc 19, then through the channels 23 of the feed header 18, exits the openings at the outer edges of the parallel discs 19, 20 and thereby enters the interior of the cyclone. The openings at the outer edges of the parallel discs 19, 20 may be configured on a single spatial and/or linear plane, or may be staggered from a number of higher to lower spatial linear planes. See FIG. 3C.

While a preferred embodiment, and an alternative preferred embodiment, have been described, various modifications may be made without departing from the spirit and scope of the present invention as articulated in the appended claims. It is desired to encompass such modifications, alterations and changes within this invention.

I claim:

1. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, and wherein said feed line terminates in a means for discharging a feed to the cyclone apparatus.

2. The cyclone apparatus of claim 1 wherein one or both of the conical shells is comprised of one or more segmented conical sections of varying curvature.

3. The cyclone apparatus of claim 1 wherein one or both of the conical shells is comprised of one or more segmented conical sections of nonvarying curvature.

4. The cyclone apparatus of claim 1 wherein the smallest diameter of the two conical shells are of equal dimension.

5. The cyclone apparatus of claim 1 wherein the smallest diameter of the two conical shells are of unequal dimension.

6. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, and wherein said feed line terminates in a means for discharging a feed to the cyclone apparatus.

7. The cyclone apparatus of claim 6 wherein one or both of the conical shells is comprised of one or more segmented conical sections of varying curvature.

8. The cyclone apparatus of claim 6 wherein one or both of the conical shells is comprised of one or more segmented conical sections of nonvarying curvature.

9. The cyclone apparatus of claim 6 wherein the smallest diameter of the two conical shells are of equal dimension.

10. The cyclone apparatus of claim 6 wherein the smallest diameter of the two conical shells are of unequal dimension.

11. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, wherein said feed line is connected to a feed supply line that is sufficiently flexible to permit adjustment of the position of the feed line during operation of the cyclone apparatus, and wherein said feed line terminates in a means for discharging a feed to the cyclone apparatus.

12. The cyclone apparatus of claim 11 wherein one or both of the conical shells is comprised of one or more segmented conical sections of varying curvature.

13. The cyclone apparatus of claim 11 wherein one or both of the conical shells is comprised of one or more segmented conical sections of nonvarying curvature.

14. The cyclone apparatus of claim 11 wherein the smallest diameter of the two conical shells are of equal dimension.

15. The cyclone apparatus of claim 11 wherein the smallest diameter of the two conical shells are of unequal dimension.

16. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, and wherein said feed line terminates in a single feed port that discharges a feed to the cyclone apparatus.

17. The cyclone apparatus of claim 16 wherein one or both of the conical shells is comprised of one or more segmented conical sections of varying curvature.

18. The cyclone apparatus of claim 16 wherein one or both of the conical shells is comprised of one or more segmented conical sections of nonvarying curvature.

19. The cyclone apparatus of claim 16 wherein the smallest diameter of the two conical shells are of equal dimension.

20. The cyclone apparatus of claim 16 wherein the smallest diameter of the two conical shells are of unequal dimension.

21. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, and wherein said feed line terminates in a single feed port that discharges a feed to the cyclone apparatus.

22. The cyclone apparatus of claim 21 wherein one or both of the conical shells is comprised of one or more segmented conical sections of varying curvature.

23. The cyclone apparatus of claim 21 wherein one or both of the conical shells is comprised of one or more segmented conical sections of nonvarying curvature.

24. The cyclone apparatus of claim 21 wherein the smallest diameter of the two conical shells are of equal dimension.

25. The cyclone apparatus of claim 21 wherein the smallest diameter of the two conical shells are of unequal dimension.

26. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, wherein said feed line is connected to a feed supply line that is sufficiently flexible to permit adjustment of the position of the feed line during operation of the cyclone apparatus, and wherein said feed line terminates in a single feed port that discharges a feed to the cyclone apparatus.

27. The cyclone apparatus of claim 26 wherein one or both of the conical shells is comprised of one or more segmented conical sections of varying curvature.

28. The cyclone apparatus of claim 26 wherein one or both of the conical shells is comprised of one or more segmented conical sections of nonvarying curvature.

29. The cyclone apparatus of claim 26 wherein the smallest diameter of the two conical shells are of equal dimension.

30. The cyclone apparatus of claim 26 wherein the smallest diameter of the two conical shells are of unequal dimension.

31. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, and wherein said feed line terminates in multiple feed ports that discharge a feed to the cyclone apparatus.

32. The cyclone apparatus of claim 3 wherein one or both of the conical shells is comprised of one or more segmented conical sections of varying curvature.

33. The cyclone apparatus of claim 31 wherein one or both of the conical shells is comprised of one or more segmented conical sections of nonvarying curvature.

34. The cyclone apparatus of claim 31 wherein the smallest diameter of the two conical shells are of equal dimension.

35. The cyclone apparatus of claim 31 wherein the smallest diameter of the two conical shells are of unequal dimension.

36. The cyclone apparatus of claim 31 wherein said multiple feed ports are aligned in a single plane.

37. The cyclone apparatus of claim 31 wherein said multiple feed ports are aligned in a staggered configuration from a higher to a lower spatial plane.

38. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, and wherein said feed line terminates in multiple feed ports that discharge a feed to the cyclone apparatus.

39. The cyclone apparatus of claim 38 wherein one or both of the conical shells is comprised of one or more segmented conical sections of varying curvature.

40. The cyclone apparatus of claim 38 wherein one or both of the conical shells is comprised of one or more segmented conical sections of nonvarying curvature.

41. The cyclone apparatus of claim 38 wherein the smallest diameter of the two conical shells are of equal dimension.

42. The cyclone apparatus of claim 38 wherein the smallest diameter of the two conical shells are of unequal dimension.

43. The cyclone apparatus of claim 38 wherein said multiple feed ports are aligned in a single plane.

44. The cyclone apparatus of claim 38 wherein said multiple feed ports are aligned in a staggered configuration from a higher to a lower spatial plane.

45. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, wherein said feed line is connected to a feed supply line that is sufficiently flexible to permit adjustment of the position of the feed line during operation of the cyclone apparatus, and wherein said feed line terminates in multiple feed ports that discharge a feed to the cyclone apparatus.

46. The cyclone apparatus of claim 45 wherein one or both of the conical shells is comprised of one or more segmented conical sections of varying curvature.

47. The cyclone apparatus of claim 45 wherein one or both of the conical shells is comprised of one or more segmented conical sections of nonvarying curvature.

48. The cyclone apparatus of claim 45 wherein the smallest diameter of the two conical shells are of equal dimension.

49. The cyclone apparatus of claim 45 wherein the smallest diameter of the two conical shells are of unequal dimension.

50. The cyclone apparatus of claim 45 wherein said multiple feed ports are aligned in a single plane.

51. The cyclone apparatus of claim 45 wherein said multiple feed ports are aligned in a staggered configuration from a higher to a lower spatial plane.

52. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, and wherein there is an annular opening between said feed line and said opening of said conical shell;

a disc with an interior open section mounted at the termination of, and approximately perpendicular to, the feed line so as to permit discharge from the feed line;

blades mounted to said disc in a pattern that channels a feed outward to the outer edge of said disc;

a solid disc mounted parallel to the aforesaid disc on the opposite edge of the aforesaid blades.

53. The cyclone apparatus of claim 52 wherein one or both of the conical shells is comprised of one or more segmented conical sections of varying curvature.

54. The cyclone apparatus of claim 52 wherein one or both of the conical shells is comprised of one or more segmented conical sections of nonvarying curvature.

55. The cyclone apparatus of claim 52 wherein the smallest diameter of the two conical shells are of equal dimension.

56. The cyclone apparatus of claim 52 wherein the smallest diameter of the two conical shells are of unequal dimension.

57. The cyclone apparatus of claim 52 wherein said blades channel the feed outward to the outer edge of said disc, to outlets configured on a single spatial plane approximately perpendicular to the feed line.

58. The cyclone apparatus of claim 52 wherein said blades channel the feed outward to the outer edge of said disc, to outlets configured on staggered spatial planes approximately perpendicular to the feed line.

59. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, and wherein said feed line is mounted to an adjustable support external to the cyclone apparatus to permit adjustment of the position of the feed line within the cyclone apparatus;

a disc with an interior open section mounted at the termination of, and approximately perpendicular to, the feed line so as to permit discharge from the feed line;

blades mounted to said disc in a pattern that channels the feed outward to the outer edge of said disc;

a solid disc mounted parallel to the aforesaid disc on the opposite edge of the aforesaid blades.

60. The cyclone apparatus of claim 59 wherein one or both of the conical shells is comprised of one or more segmented conical sections of varying curvature.

61. The cyclone apparatus of claim 59 wherein one or both of the conical shells is comprised of one or more segmented conical sections of nonvarying curvature.

62. The cyclone apparatus of claim 59 wherein the smallest diameter of the two conical shells are of equal dimension.

63. The cyclone apparatus of claim 59 wherein the smallest diameter of the two conical shells are of unequal dimension.

64. The cyclone apparatus of claim 59 wherein said blades channel a feed outward to the outer edge of said disc, to outlets configured on a single spatial plane approximately perpendicular to the feed line.

65. The cyclone apparatus of claim 59 wherein said blades channel a feed outward to the outer edge of said disc, the outlets configured on staggered spatial planes approximately perpendicular to the feed line.

66. A cyclone apparatus comprising: a cylindrical shell having joined at one orifice a conical shell with the largest diameter of the conical shell matching the diameter of the cylindrical shell, wherein said conical shell is truncated and open, and with said cylindrical shell having joined at the other orifice another conical shell with the largest diameter of the second conical shell also matching the diameter of the cylindrical shell, wherein said conical shell is truncated and open;

a feed line entering the cyclone apparatus through the opening at the smallest diameter of one of the two conical shells, wherein said feed line is positioned coincident with the central internal axis of the cyclone apparatus, wherein there is an annular opening between said feed line and said opening of said conical shell, wherein said feed line is mounted to an adjustable support external to the cyclone apparatus to permit adjustment of the position of the feed line within the cyclone apparatus, and wherein said feed line is connected to a feed supply line that is sufficiently flexible to permit adjustment of the position of the feed line during operation of the cyclone apparatus;

a disc with an interior open section mounted at the termination of, and approximately perpendicular to, the feed line so as to permit discharge from the feed pipe;

blades mounted to said disc in a pattern that channels a feed outward to the outer edge of said disc;

a solid disc mounted parallel to the aforesaid disc on the opposite edge of the aforesaid blades.

67. The cyclone apparatus of claim 66 wherein one or both of the conical shells is comprised of one or more segmented conical sections of varying curvature.

68. The cyclone apparatus of claim 66 wherein one or both of the conical shells is comprised of one or more segmented conical sections of nonvarying curvature.

69. The cyclone apparatus of claim 66 wherein the smallest diameter of the two conical shells are of equal dimension.

70. The cyclone apparatus of claim 66 wherein the smallest diameter of the two conical shells are of unequal dimension.

71. The cyclone apparatus of claim 66 wherein said blades channel the feed outward to the outer edge of said disc, to outlets configured on a single spatial plane approximately perpendicular to the feed line.

72. The cyclone apparatus of claim 66 wherein said blades channel the feed outward to the outer edge of said disc, to outlets configured on staggered spatial planes approximately perpendicular to the feed line.

* * * * *